US008511950B1

(12) United States Patent
Bell

(10) Patent No.: US 8,511,950 B1
(45) Date of Patent: Aug. 20, 2013

(54) CONTAINER FOR OVERSIZED CARGO

(75) Inventor: Warren J. Bell, Kent, WA (US)

(73) Assignee: BNSF Railway Company, Fort Worth, TX (US)

( * ) Notice: Subject to any disclaimer, the term of this patent is extended or adjusted under 35 U.S.C. 154(b) by 293 days.

(21) Appl. No.: 12/799,341

(22) Filed: Apr. 22, 2010

Related U.S. Application Data

(62) Division of application No. 11/334,248, filed on Jan. 18, 2006, now Pat. No. 7,731,459.

(60) Provisional application No. 60/645,636, filed on Jan. 21, 2005.

(51) Int. Cl.
*B60P 7/08* (2006.01)

(52) U.S. Cl.
USPC ..... 410/68; 410/46

(58) Field of Classification Search
USPC ..... 410/32, 35, 46, 68, 82, 156; 220/1.5, 220/4.26, 4.27, 23.4, 23.6; 24/287; 105/355; 206/503
See application file for complete search history.

(56) References Cited

U.S. PATENT DOCUMENTS

| | | | | |
|---|---|---|---|---|
| 4,478,155 | A | 10/1984 | Cena et al. | |
| 5,183,375 | A * | 2/1993 | Fenton et al. | 410/35 |
| 7,731,459 | B2 * | 6/2010 | Bell | 410/68 |
| 2004/0239135 | A1 | 12/2004 | Mehrer | |

* cited by examiner

*Primary Examiner* — Stephen Gordon
(74) *Attorney, Agent, or Firm* — Thompson & Knight LLP; James J. Murphy

(57) ABSTRACT

A transportation container includes an upper section having a plurality of sidewalls defining a space dimensioned to receive oversized cargo for transport and a base section adapted to mate with a standardized interface of a transportation vehicle for supporting the upper section.

4 Claims, 9 Drawing Sheets

CONTAINER FOR OVERSIZED CARGO

CROSS REFERENCE TO RELATED APPLICATION

This application for patent is a divisional of pending application Ser. No. 11/334,248, filed Jan. 18, 2006, now U.S. Pat. No. 7,731,459.

This application claims priority of Provisional Application Ser. No. 60/645,636 filed Jan. 21, 2005.

FIELD OF THE INVENTION

The present invention relates generally to containers for shipment of cargo and more particularly to containers for shipment of oversized cargo that does not fit within standard enclosed shipping containers.

BACKGROUND OF THE INVENTION

Throughout the world, goods are shipped via a wide variety of transportation methods in metal containers. Typically, the containers used are constructed of steel or aluminum and have dimensions that comply with standards set by the International Organization for Standardization ("ISO"). Standardization allows the containers to be handled by mechanical equipment, regardless of location or manufacturer of the container or equipment.

Standardization also allows the same container to be used on various forms of transportation. This is particularly advantageous because it allows the cargo to be transferred between transportation forms without a lengthy process of unloading and re-loading the container itself. For example, a loaded container may be off-loaded from a ship by an overhead crane and loaded directly onto a truck or rail car.

While most goods can be transported in standard-dimension containers, some cargo is simply too large to fit within a standard container. Also, it has not been efficient to construct oversized containers for these goods because such oversized containers would not meet the dimensional standards for shipping containers. Typically, therefore, oversized goods are individually loaded on flat-bed rolling stock for overland transportation or individually loaded and secured on cargo ships for sea transportation. In certain cases, flat-bed rail cars have been fitted with canopies to cover the cargo. An example of such a modified flat-bed rail car is shown in FIG. 1. This approach has proven undesirable, however, because the flat-bed cars so modified are not available for general use in providing railroad-transportation services when not being used for oversized cargo. Rather, once modified, the rail cars have limited application to oversized cargo.

The inability to use containers for oversized goods has disadvantages. Specifically, the goods must be individually loaded onto rolling stock at the point of manufacture and then unloaded and re-loaded at each point of transfer between transportation forms. For example, oversized goods loaded on a flat-bed rail car must be individually unloaded from the rail car and then individually loaded onto a cargo ship for sea transportation. Also, the inability to use a container may result in the goods being exposed to weather during transport or may require individualized protection, such as canopies or tarpaulins, to be used to protect the goods from the weather.

A need exists therefore for a shipping container that would accommodate oversized goods while still meeting critical dimensional standards for standardized containers.

SUMMARY OF THE INVENTION

To meet the foregoing needs, the present invention provides a shipping container that has a base section having a width of a standard shipping container and an upper section that has a width greater than the width of the base section. The base section is configured to interface with rolling stock designed for transportation of standard shipping containers. The base section has length and width dimensions of standard shipping containers. For example, the base section has a width to fit within the well of a railroad well car and a height that is greater than the depth of the well. At the four lower corners of the base section are standard container corner fittings. These fittings permit the container of the present invention to interface with existing equipment for handling and securing standard shipping containers.

The shipping container of the present invention has an upper section connected to the base section, with the upper section having a width greater than that of the base section. When installed on a railroad well car, the width of the upper section is at least as wide as the width of the well, and may even be wider than the width of the rail car. The width of the upper section allows oversized cargo to be loaded into and shipped within the container. The present invention is also advantageous because the outer dimensions remain fixed regardless of the cargo being transported. This is especially important for rail transportation, where special clearances may be required for oversized shipments. Because the outer dimensions are fixed using the present invention, once an oversized container has been cleared for a particular route, it need not undergo the same clearance procedure when a different cargo is subsequently transported over that route.

DETAILED DESCRIPTION OF THE INVENTION

In the following detailed description of the invention, reference is made to the accompanying drawings, which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The use of shipping containers for transportation of cargo is well known, as it provides a convenient technique for transporting the cargo through multiple transportation methods. The present invention provides a container that retains the inter-modal functionality of shipping containers but accommodates certain oversized cargo that does not fit within standard-width shipping containers.

Figure 1:
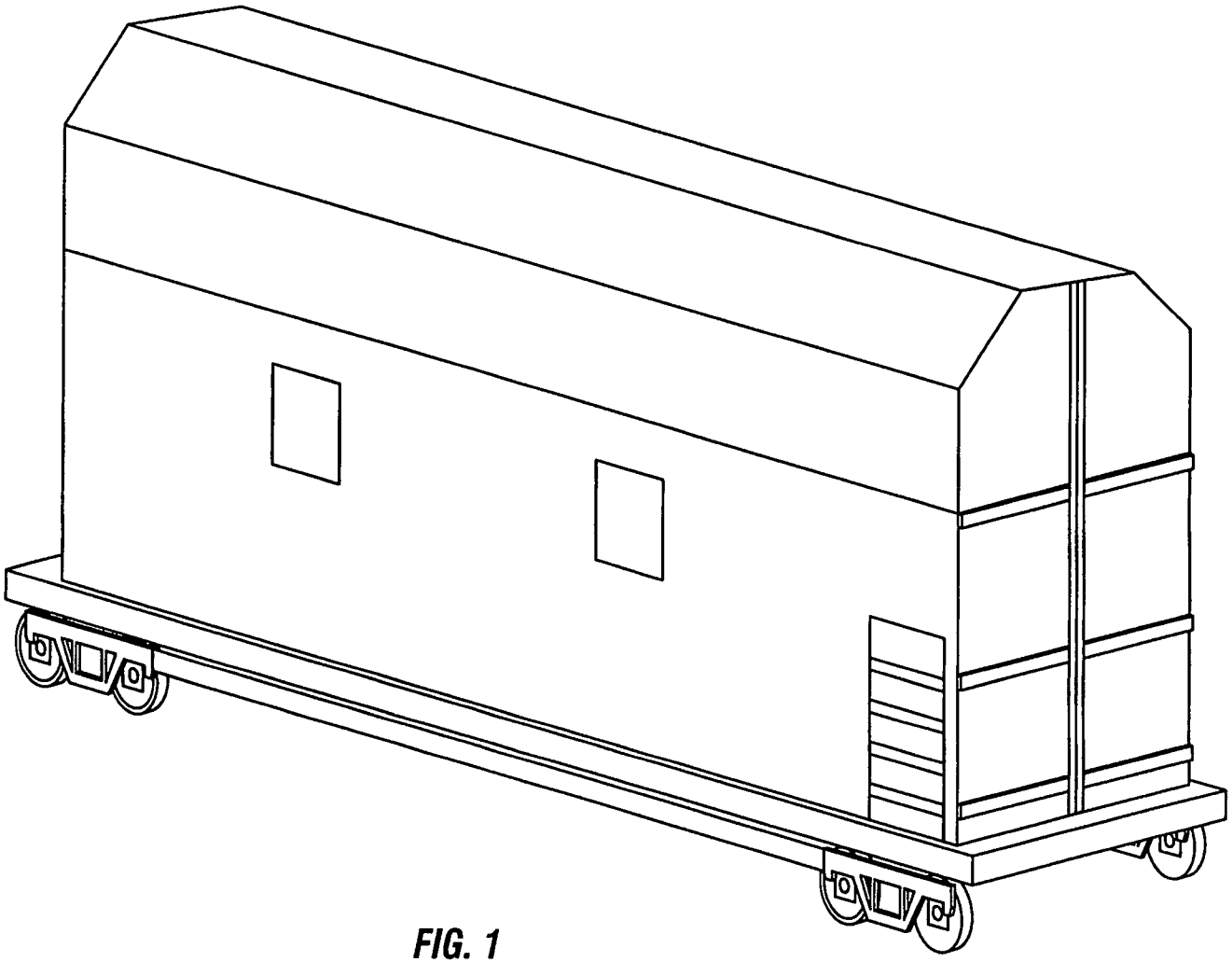
FIG. 1 (Prior Art)
FIG. 1 shows a prior-art flat-bed rail car modified to incorporate a canopy to enclose oversized cargo.
Figure 2:
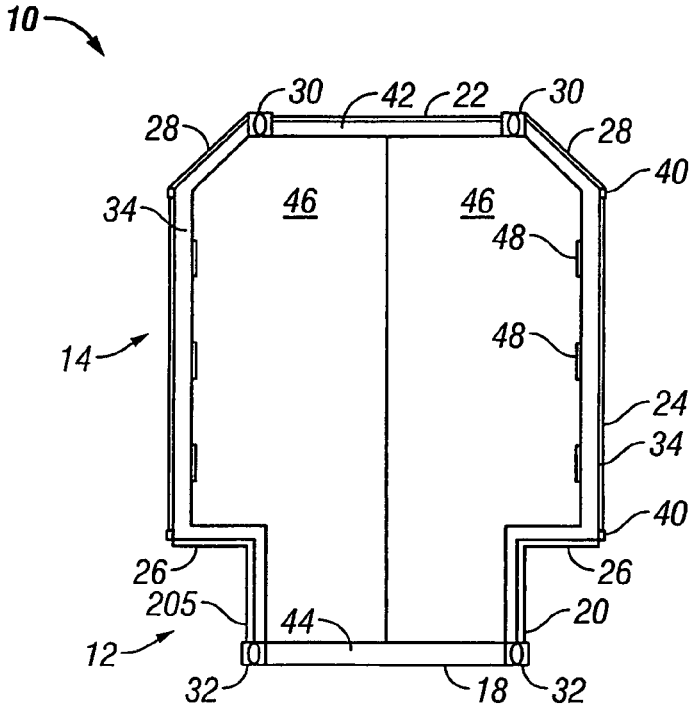
FIG. 2 shows an end view of a preferred embodiment of the oversized container according to the present invention.
Figure 4:
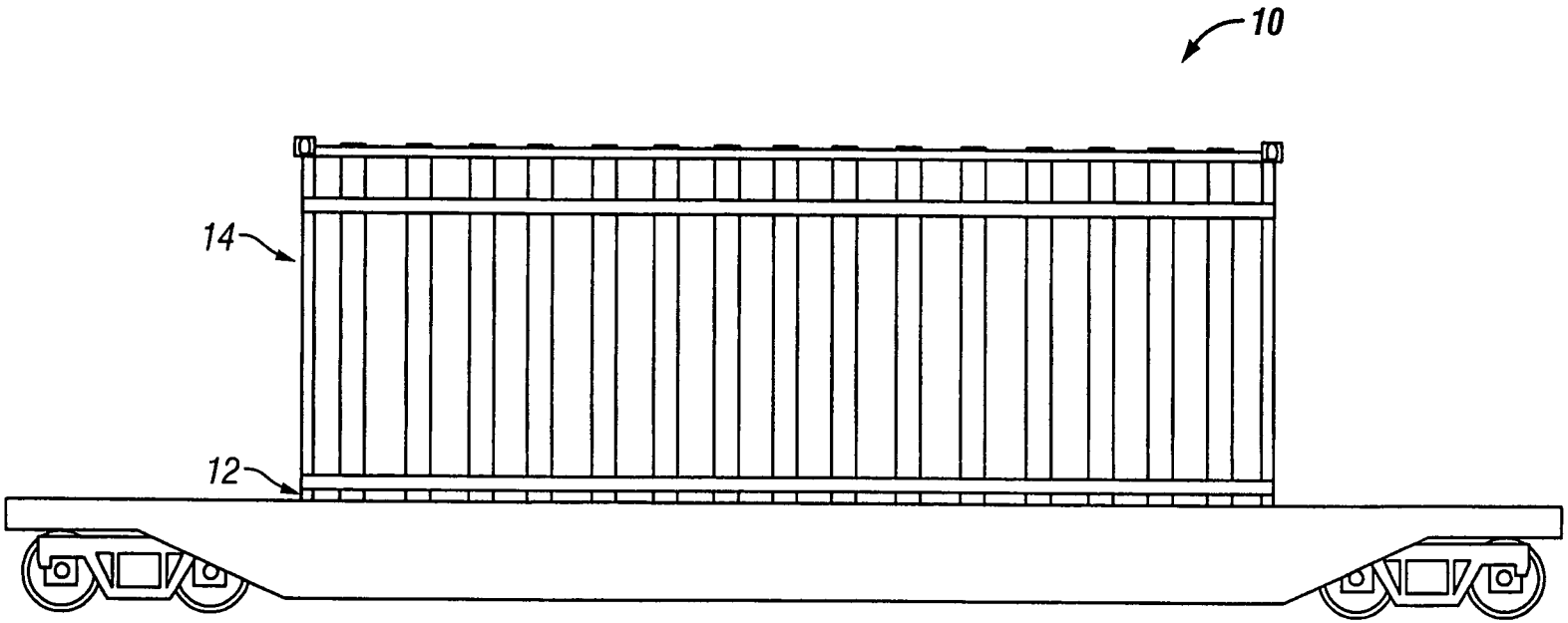
FIG. 4 shows a side view of the oversized container loaded on a railroad well car.

Referring to FIG. 2, the preferred embodiment of the oversized shipping container 10 includes a base section 12 and an upper section 14, which has a width that is greater than the width of the base section 12. Preferably, the base section 12 and upper section 14 define an interior volume of the container. Base section 12 contains a bottom wall 18 and two side walls 20. Typically, base section 12 will have a width of 96 inches or 102 inches, the two standard widths for shipping containers. Base section 12 has a height that is greater than the depth of the well in a railroad well car. FIG. 4 shows oversized container 10 loaded on a typical railroad well car.

Referring again to FIG. 2, upper section 14 of container 10 includes an upper wall 22 and two side walls 24. Upper section 14 also includes two connection wall sections 26, which connect the base-section side walls 20 with the upper section side walls 24. Also, container 10 preferably has chamfered upper corners walls 28, which enable the container to meet certain clearance requirements for tunnels and other obstructions when the container is used for rail transportation.

As with standard containers, the oversized container 10 includes four upper corner fittings 30, which are configured and spaced according to standard container specifications to interface with standard overhead container cranes and other machinery used for lifting and moving standard shipping containers. Oversized container 10 also includes four lower corner fittings 32, which are located at the four corners of bottom wall 18. The lower corner fittings 32 are configured and spaced according to standard container specifications to interface with mechanical locks and hold-down equipment on rolling stock or ships or on top of other containers.

Figure 3:
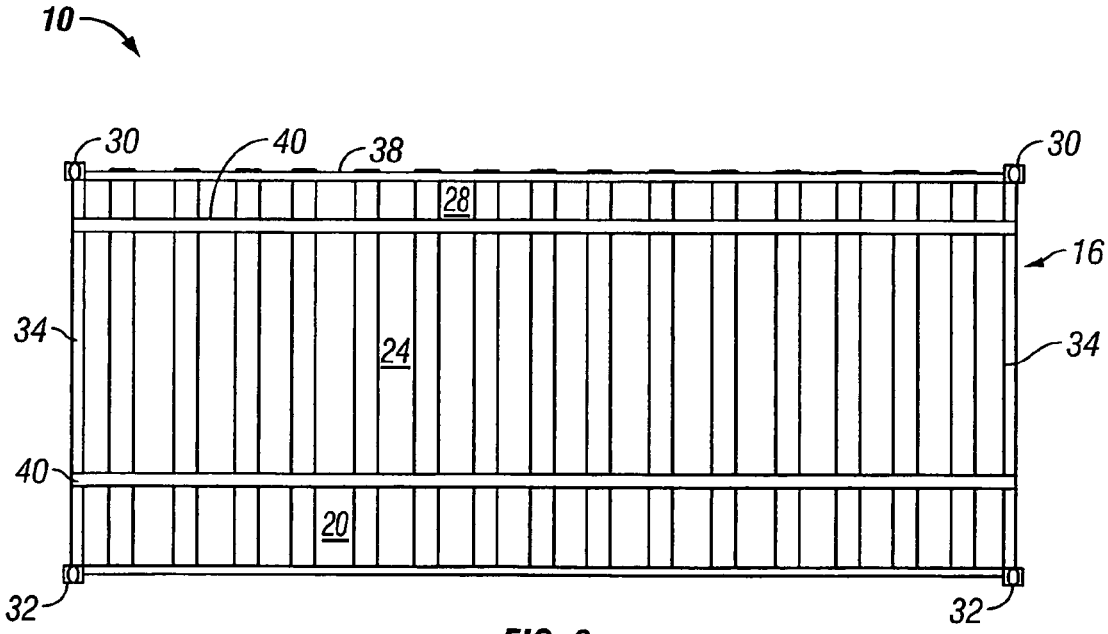
FIG. 3 shows a side view of a preferred embodiment of the oversized container according to the present invention.

FIG. 3 shows a side view of the preferred embodiment of oversized container 10. Persons skilled in the art will appreciate that during lifting operations, a mechanical crane or similar machine (not shown) will engage the container 10 through mechanical locks at the four upper corner fittings 30. Much of the structural load associated with lifting operations will pass through four corner posts 34 (FIGS. 2 and 3), one of which is located at each corner of the container. In a standard shipping container having a rectangular cross section, the corner posts are straight members. Because oversized container 10 has upper section 14 having a width greater than the width of base section 12, corner posts 34 are typically not straight members, as shown most clearly in FIG. 2.

Referring again to FIG. 3, oversized container 10 preferably has a frame that includes two lower longitudinal support members 36 extending the length of the container at the lower extent of base section side walls 20. Similarly, two upper longitudinal support members 38 preferably extend the length of the container at the upper extent of chamfered upper corner walls 28. In addition, container 10 preferably includes medial longitudinal support members 40 at opposite extents of each upper section side wall 24. Preferably, the primary structures of the frame for container 10, including the corner posts 34, the longitudinal support members 36, 38, and 40, as well as upper and lower end support members 42 and 44, respectively, are made of steel, although other materials such as aluminum could be used.

Upper and base section side walls 24 and 20, as well as upper wall 22, are typically made of corrugated steel, although, again, other materials such as aluminum could be used. As an alternative to corrugated material, smooth surface materials, including laminated or composite materials, can be used for the walls of the container. Because in the preferred embodiment, the weight of the cargo is supported by the lower wall 18, the lower wall 18 is sufficiently rigid to support the cargo without appreciable bending or deformation.

The oversized container 10 can be of any length, although typical lengths for containers are 20 feet, 28 feet, 40 feet, and 48 feet. On typical overhead-lift equipment, the interface points for lifting containers are spaced either 20 or 40 feet apart along the longitudinal axis of the equipment. Accordingly, if the oversized container 10 is 20 or 40 feet in length, the upper corner fittings are located at the extents of the length of container 10, as shown in FIG. 3. If oversized container 10 has a length that is not a multiple of 20 feet, upper corner fittings 30 are spaced at 20 or 40 foot spacing, centered along the length of the container. For example, for a container that is 48 feet in length, the corner fittings will be spaced apart 40 feet, with each fitting located 4 feet from the nearest end of the container.

Referring again to FIG. 2, in the preferred embodiment, each end 16 of the oversized container 10 is fitted with two doors 46, each of which is secured to a corner post 34 by a plurality of hinges 48 adjacent the upper section side wall 24. The doors 46 on each end 16 of the container will include locking mechanisms (not shown) that are well-known in the art.

Other configurations could be used, however, for loading and unloading cargo. For example, rather than (or in addition to) end doors, the container 10 alternatively could be configured such that the upper wall 22 is removable using overhead equipment. This would allow for the cargo to be loaded into the container from above. In this alternative configuration, all or portions of the chamfered upper corner walls may also be removable with the upper wall 22.

Figure 5:
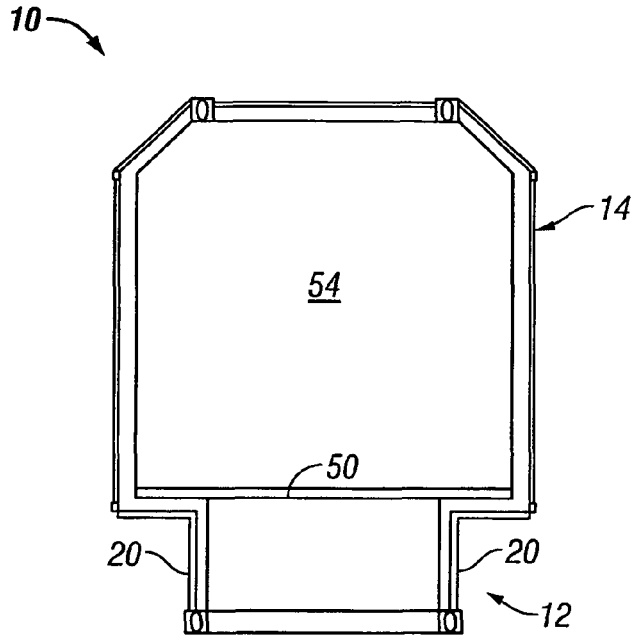
FIG. 5 shows an end view of an alternative embodiment of the oversized container according to the present invention wherein an auxiliary floor is installed within the container.

In an alternative embodiment of the invention shown in FIG. 5 (with the end doors removed), an auxiliary floor 50 is installed between the base section 12 and the upper section 14 to divide the container volume into a base compartment 52 and an upper compartment 54. In this alternative embodiment, because the weight of the cargo stored in the upper compartment 54 would be supported by the floor 50, the structure associated with the base section wall 20 would need to be reinforced to transfer the weight to the lower corner fittings 32.

Figure 6:
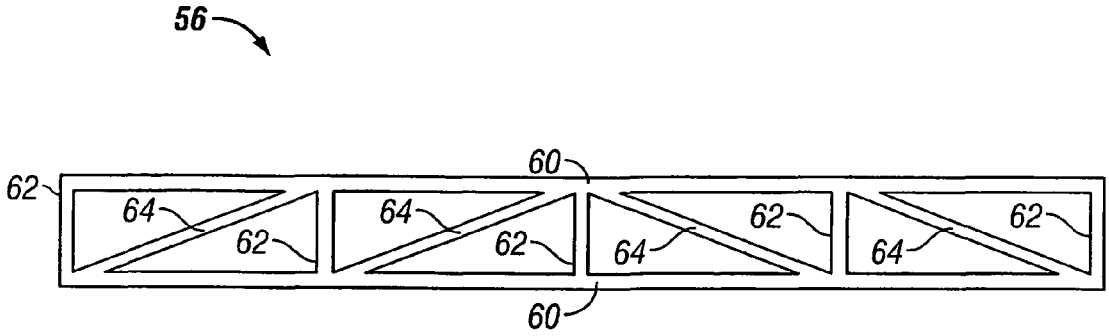
FIG. 6 shows a side view of a reinforced frame forming the side of the base section in the alternative embodiment shown in FIG. 5.

For example, as shown in FIG. 6, two support frames 56 located on opposite longitudinal sides of the base compartment 52 includes longitudinal upper beams 58 and longitudinal lower beams 60 connected by a plurality of base support posts 62. In this embodiment, diagonal braces 64 are included between support posts 62 to resist shearing loads.

In the embodiment shown in FIG. 5, base compartment 52 could be used for a variety of purposes. For example, base compartment 52 could be used for storage of cargo in addition to the cargo stored in upper compartment 54. Base compartment 52 could alternatively be used to house a variety of equipment for use in the container. In some applications, it would be desirable for the oversized container 10 to provide electrical power for the cargo located within the container. The base compartment would provide a convenient location to house one or more electrical generators to provide the power for the container. In such a configuration, those skilled in the art would recognize that provision would be required to vent the exhaust gases produced by the power-generation equipment. In other applications, it may be desirable to provide the container with a climate-controlled environment. For these applications, refrigeration and/or heating equipment could be located in the base compartment 52 for controlling the environment in upper compartment 54. Those skilled in the art will appreciate that, if a climate-controlled environment for container 10 is required, it would be preferable for the container doors to be capable of being sealed tightly and for the walls to be made of insulating materials.

Figure 7:
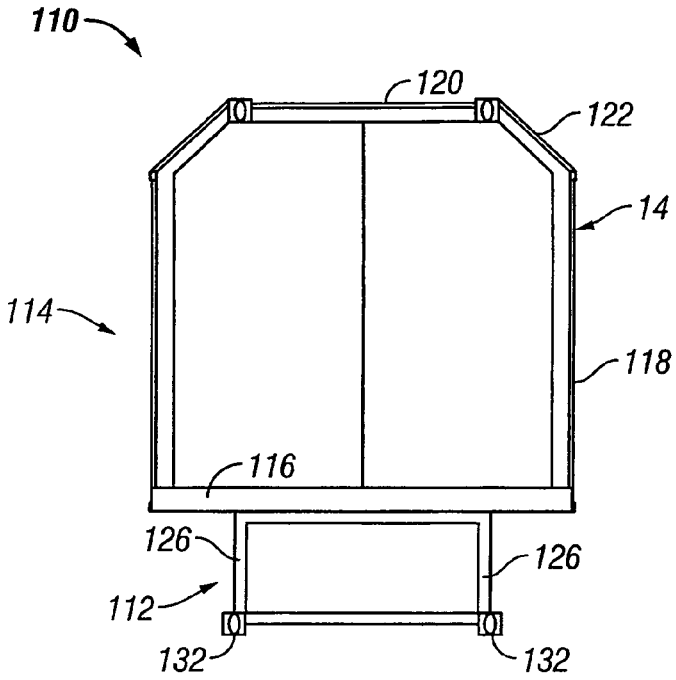
FIG. 7 shows an end view of another alternative embodiment of the oversized container according to the present invention wherein the base portion is external to the container.
Figure 8:
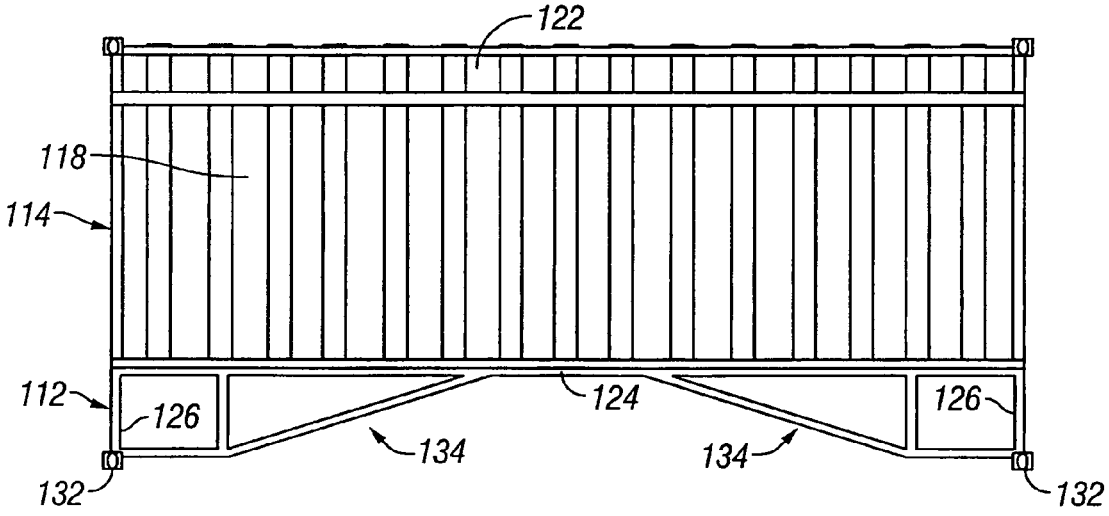
FIG. 8 shows a side view of the alternative embodiment of FIG. 7.

A second alternative embodiment of the invention is shown in FIGS. 7 and 8. In this embodiment, oversized container 110 has a base section 112 and an upper section 114. In this embodiment, the base section 112 does not enclose a volume internal to the container. The upper section 114 includes a floor 116, which is substantially planar. Upper section 114 includes two side walls 118, an upper wall 120, and chamfered upper corner walls 122. The base section 112 is a mechanical support having a height of at least the depth of the well of a railroad well car. In the embodiment shown in FIGS. 7 and 8, base section 112 includes two longitudinal floor support beams 124, one on each side of base section 112. Base section 112 includes four corner support posts 126 to provide the primary structural support between lower corner fittings 132 and the longitudinal floor support beams 124. In this embodiment, base section 112 also includes truss structures 134 to provide structural support to corner support posts 126.

Figure 9:
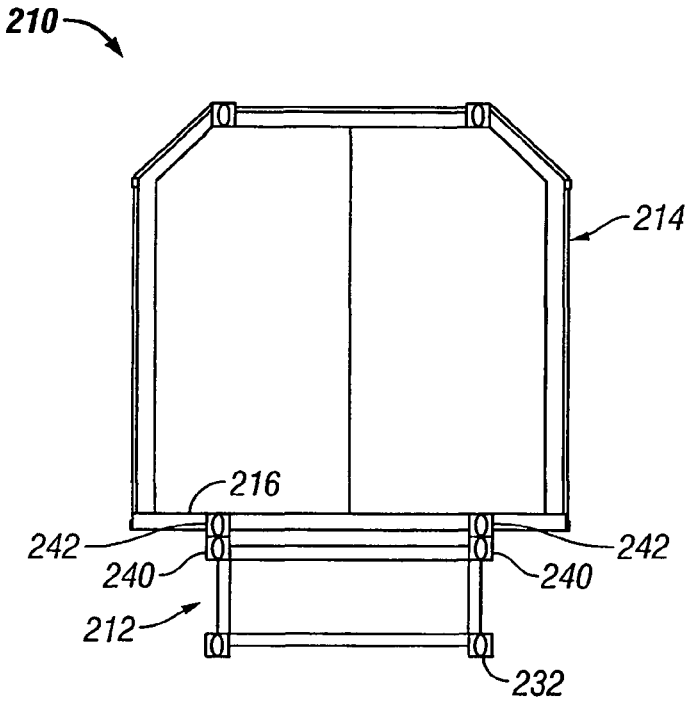
FIG. 9 shows an end view of another alternative embodiment of the oversized container according to the present invention wherein the base portion is external to and detachable from the container.
Figure 10:
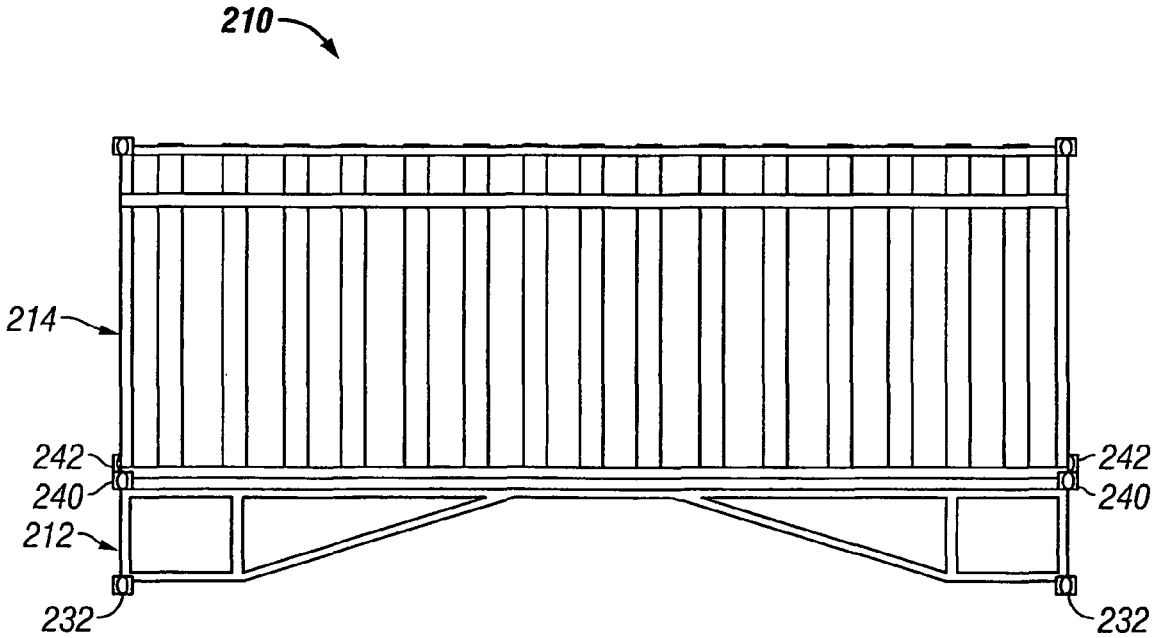
FIG. 10 shows a side view of the alternative embodiment of FIG. 9.

A third alternative embodiment of the invention is shown in FIGS. 9 and 10. In this embodiment, oversized container 210 has a base section 212 and an upper section 214, which are detachable from each other. Base section lower corner fittings 232 are located on the bottom of base section 212, and base section upper corner fittings 240 are located on the top of base section 212. Base section upper corner fittings 240 are positioned to correspond to the location of upper section lower fittings 242. The configuration of base section upper corner fittings 240 and upper section lower fittings 242 allows the upper section 214 to be stacked on base section 212 and locked in place using standard container locking mechanisms used for stacking standard shipping containers. These locking mechanisms are well-understood by persons of ordinary skill in the art.

Figure 11:
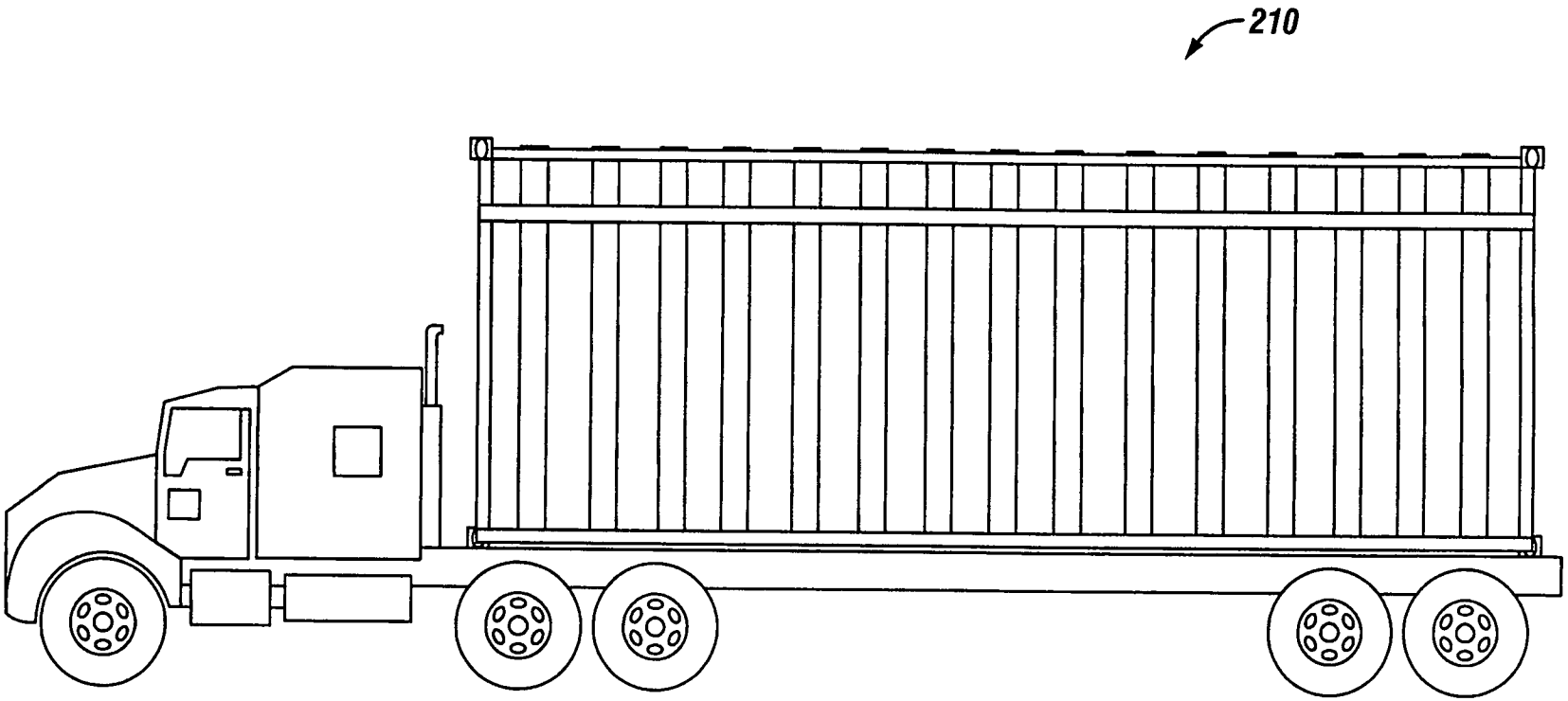
FIG. 11 shows a portion of the alternative embodiment of FIG. 9 loaded on a truck.

During transportation by rail, when oversized container 210 is secured in a well car, base section 212 is necessary so that the upper section 214, which has a width greater than the width of the well of the well car, is positioned above the sides of the well car. However, if the cargo must also be shipped by truck or other form of transport, it may be desirable to reduce the overall height of the container. Accordingly, base section 212 can be detached from upper section 214 by removing the locking mechanisms that secure base section upper corner fittings 240 to upper section lower corner fittings 242. Once detached, upper section 212 can be loaded onto the truck or other vehicle and secured using upper section lower fittings 242, which are spaced at the appropriate dimensions to be secured using standard container-securing equipment located on the truck or other vehicle. By way of example, FIG. 11 shows oversized container 210, with base section 212 detached, loaded on a truck for ground transportation.

Figure 13:
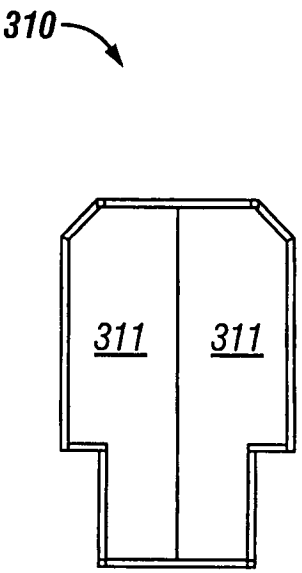
FIG. 13 is an end view of the alternate embodiment shown in FIG. 12.
Figure 12:
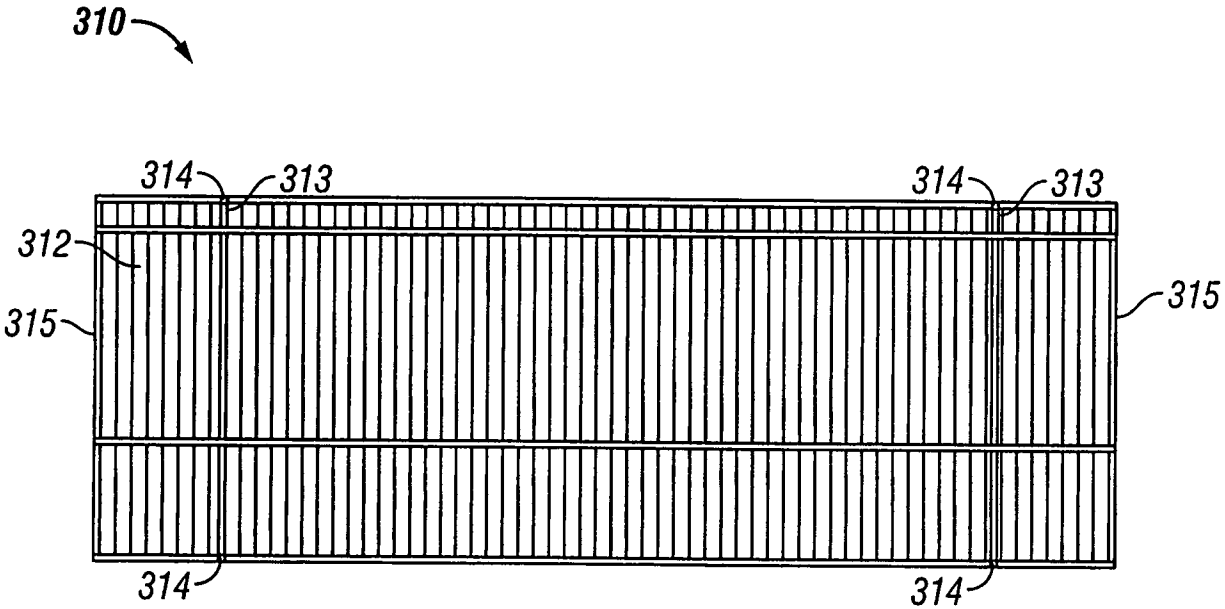
FIG. 12 shows a side view of an alternate embodiment of the present invention demonstrating one exemplary variation in container construction.
Figure 14:
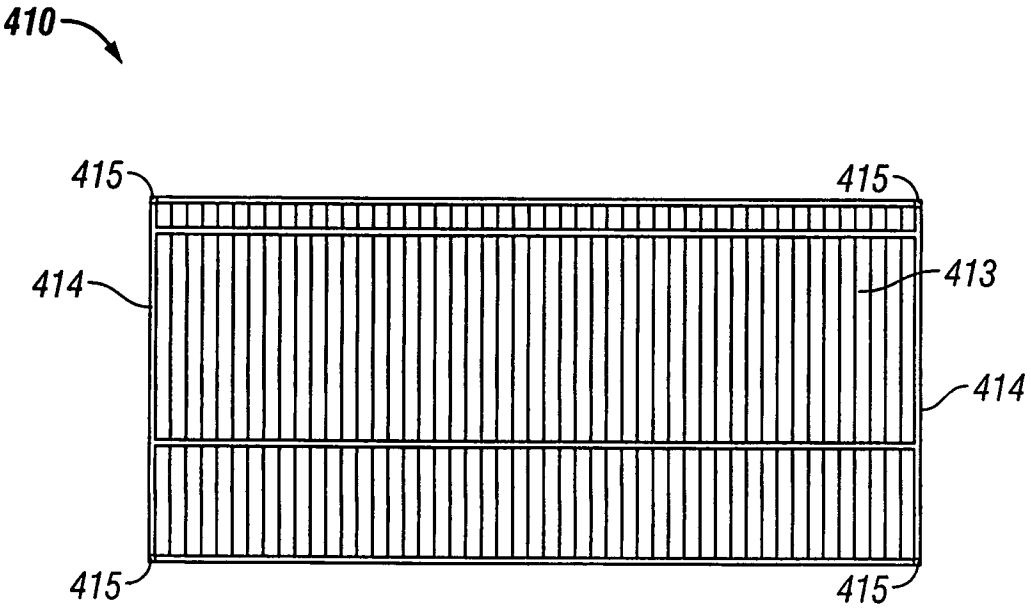
FIG. 14 shows a side view of an alternate embodiment of the present invention demonstrating another exemplary variation in container construction.

A fourth alternate embodiment of the present invention is depicted in FIGS. 12 and 14. In particular, an oversized cargo container 310 is shown which includes full size vertical doors 311 for the ingress and egress of cargo. Additionally, an alternate corrugated construction is utilized for container sidewalls 312. Container 310 further includes vertical reinforcing posts 313 and fittings 314, which are spaced from vertical end-posts 315 and which provide for lifting and fastening of container 313 from an associated transportation platform. The dimensions of container 310 shown in FIGS. 12 and 13 are representative, and may vary from design to design, and required for a particular application.

Figure 15:
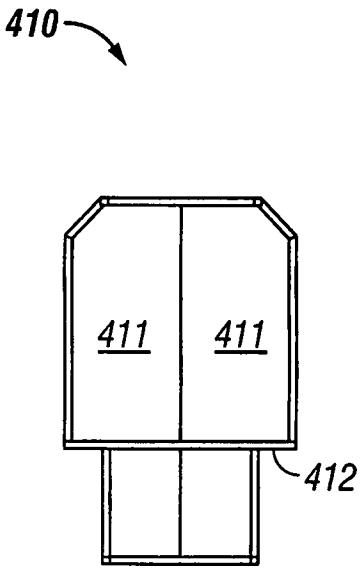
FIG. 15 is an end view of the alternate embodiment shown in FIG. 14.

A fifth embodiment is shown in FIGS. 14 and 15. Here, an oversized cargo container 410 is depicted that utilizes partial vertical doors 411, which extend upward from auxiliary floor 412, for accessing the container interior. Container 410 is also includes sidewalls 413 that are constructed from an alternate corrugated material. Fastening and lifting of container 410 are facilitated by vertical end-posts 414 and fittings 415. The dimensions of container 410 shown in FIGS. 14 and 15 are exemplary only, and may vary from actual design to actual design, as required for the given application.

Although an embodiment of the present invention has been shown and described in detail herein, along with certain variants thereof, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention.

What is claimed is:

1. A transportation system comprising:

a welled transportation vehicle including:

a platform with a longitudinal axis and outer vertical sidewalls spaced by a standard platform-width and disposed substantially in parallel to the longitudinal axis, the outer vertical sidewalls of the platform defining outer lateral boundaries of the transportation vehicle; and a well including lateral sidewalls spaced a standard well-width and extending downward from the platform between the outer sidewalls substantially in parallel to the longitudinal axis; and a container comprising:

an upper section having a plurality of sidewalls defining a space dimensioned to receive oversized cargo for transport and having lateral sidewalls spaced by a selected first width; and a base section contiguous with and supporting the upper section and having lateral sidewalls spaced by a second width selected to allow the base section to be received within the well of the transportation vehicle, wherein the second width is less than the first width and the first width is selected such that the lateral sidewalls of the upper section are disposed laterally beyond the outer lateral boundaries of the transportation vehicle defined by the outer vertical sidewalls of the platform when the base section is received within the well.

2. The transportation system of claim 1, wherein the base section is adapted to fit within a well of a railroad well car.

3. The transportation system of claim 2, wherein the lateral sidewalls of the upper section are spaced apart at a fixed width selected to provide clearance on a selected railway route.

4. The transportation system of claim 2, wherein the transportation vehicle comprises a railroad well car and the lateral sidewalls of the upper section extend beyond lateral sides of the railroad well car.

* * * * *